US010544617B2

(12) United States Patent
Eichler et al.

(10) Patent No.: US 10,544,617 B2
(45) Date of Patent: Jan. 28, 2020

(54) METHOD FOR CONTROLLING THE OPERATION OF A MOTORISED DRIVE DEVICE OF A SLIDING WINDOW FOR A BUILDING

(71) Applicant: SOMFY ACTIVITES SA, Cluses (FR)

(72) Inventors: Mickaël Eichler, Cruseilles (FR); Thierry Garby, Chatillon sur Cluses (FR)

(73) Assignee: SOMFY ACTIVITIES SA, Cluses (FR)

( * ) Notice: Subject to any disclaimer, the term of this patent is extended or adjusted under 35 U.S.C. 154(b) by 0 days.

(21) Appl. No.: 16/343,243

(22) PCT Filed: Oct. 18, 2017

(86) PCT No.: PCT/EP2017/076572
§ 371 (c)(1),
(2) Date: Apr. 18, 2019

(87) PCT Pub. No.: WO2018/073289
PCT Pub. Date: Apr. 26, 2018

(65) Prior Publication Data

US 2019/0249478 A1 Aug. 15, 2019

(30) Foreign Application Priority Data

Oct. 19, 2016 (FR) ..... 16 60135

(51) Int. Cl.
*E05F 15/632* (2015.01)
*E05C 17/62* (2006.01)
*E05C 17/60* (2006.01)

(52) U.S. Cl.
CPC ..... *E05F 15/632* (2015.01); *E05C 17/60* (2013.01); *E05C 17/62* (2013.01); *E05Y 2201/22* (2013.01)

(58) Field of Classification Search
CPC ..... E05F 15/643; E05C 17/60; E05C 17/62
See application file for complete search history.

(56) References Cited

U.S. PATENT DOCUMENTS 164,038 A * 6/1875 Robertson ..... E05F 15/643 49/102
3,890,744 A * 6/1975 Galis ..... E05F 15/643 49/360

(Continued)

FOREIGN PATENT DOCUMENTS

DE 20 2004 017100 U1 3/2005
EP 1 681 419 A1 7/2006

(Continued)

OTHER PUBLICATIONS

International Search Report, dated Jan. 4, 2018, from corresponding PCT/EP2017/076572 application.

*Primary Examiner* — Catherine A Kelly
(74) *Attorney, Agent, or Firm* — Young & Thompson

(57) ABSTRACT

Disclosed is a sliding window for a building including a motorized drive device and device for locking an opening member relative to a window frame in a locked chained position, having a first sub-assembly on the window frame and a second sub-assembly on the opening member. Also disclosed is a method for controlling the operation of such drive device, including, during a configuration phase, a step of determining reference positions of the second sub-assembly relative to the first sub-assembly. Moreover, the method includes, during a control phase: receiving an order to control the movement of an electromechanical actuator by an electronic control unit, and moving the opening member at a first set speed or a second set speed, as a function of the order received, at least one preceding order executed and the (Continued)

position of the second sub-assembly relative to the first sub-assembly, according to the reference positions.

9 Claims, 5 Drawing Sheets

(56) References Cited

U.S. PATENT DOCUMENTS 4,893,435 A * 1/1990 Shalit ..... E05F 15/643 49/139
5,285,596 A 2/1994 Kinsey
5,377,448 A * 1/1995 Boyd ..... E05F 1/025 49/360
6,108,977 A * 8/2000 Payne ..... E05F 15/603 49/360
6,918,210 B1 * 7/2005 Smiley ..... E05F 15/643 49/347
7,325,361 B2 * 2/2008 Rogers, Jr. ..... E05F 15/643 296/155
8,324,842 B2 * 12/2012 Gasser ..... A47B 88/457 318/14
8,407,941 B2 * 4/2013 Chang ..... E05D 15/063 49/116
8,882,159 B2 * 11/2014 Kreuz ..... E05B 77/02 292/1
9,452,761 B2 * 9/2016 Romero ..... B61B 1/02
10,015,843 B2 * 7/2018 Ackerman ..... B60J 1/1853
10,392,854 B2 * 8/2019 Ottmann ..... E05F 15/643
2001/0033142 A1 * 10/2001 Wan-Sheng ..... E05F 15/56 318/445
2010/0095596 A1 * 4/2010 Luca ..... A47K 3/34 49/360
2011/0107671 A1 * 5/2011 Lloyd ..... E05F 11/54 49/32
2018/0044966 A1 * 2/2018 Brand ..... E05F 15/643

FOREIGN PATENT DOCUMENTS

FR 3029958 A1 * 6/2016 ..... E05D 15/0639
FR 3043122 A1 * 5/2017 ..... E05F 15/643
FR 3069008 A1 * 1/2019 ..... E05C 17/62

* cited by examiner

METHOD FOR CONTROLLING THE OPERATION OF A MOTORISED DRIVE DEVICE OF A SLIDING WINDOW FOR A BUILDING

The present invention relates to a method for controlling the operation of a motorized drive device of a sliding window for a building, so as to move a leaf relative to a frame in a sliding movement and to lock the leaf relative to the frame in a locked partially open position.

In general, the present invention relates to the field of windows comprising a motorized drive device setting a leaf in motion relative to a frame in a sliding movement, between at least one first position and at least one second position. A motorized drive device of such a window comprises an electromechanical actuator.

Already known are sliding windows for a building comprising a frame, a leaf and a device for locking the leaf relative to the frame in a locked partially open position. The locked partially open position is arranged between an open position and a closed position of the leaf relative to the frame. The locking device comprises a first subassembly and a second subassembly. The first subassembly is fastened on the frame. The second subassembly is fastened on the leaf. The second subassembly is configured to cooperate with the first subassembly, during the movement of the leaf relative to the frame, so as to be able to lock the leaf relative to the frame in the locked partially open position.

However, such sliding windows have the drawback of requiring maneuvering the leaf relative to the frame manually, in particular using the maneuvering handle positioned on the leaf.

As a result, the manual movement of the leaf relative to the frame to the locked partially open position may cause deterioration of the locking device, in particular when the pressure exerted on the maneuvering handle and/or the movement speed of the leaf relative to the frame are too high.

Furthermore, the manual movement of the leaf relative to the frame between the open position and the closed position, and vice versa, may cause unwanted blocking of the leaf relative to the frame in the locked partially open position.

Also already known is document DE 20 2004 017100 U1, which describes a sliding window for a building comprising a frame, a first sliding leaf and a second stationary leaf. The window also comprises a motorized drive device configured to move the first leaf by sliding relative to the frame. The motorized drive device comprises an electronic control unit. The window also comprises a locking device of the first leaf relative to the frame in the closed position of the first leaf relative to the frame.

This document also describes that, during a configuration phase, the electronic control unit determines reference positions relative to the open and closed end-of-travel positions. The electronic control unit is configured to receive, during a command phase of the motorized drive device, a command order to move the first leaf relative to the frame. The electronic control unit is also configured to move the first leaf relative to the frame at a first speed input or a second speed input, depending on the movement command order received and the position of the first leaf relative to the frame, according to the predetermined reference positions.

The present invention aims to resolve the aforementioned drawbacks and to propose a method for controlling the operation of a motorized drive device of a sliding window for a building, making it possible to move the leaf relative to the frame in a motorized manner, and to reach a locked partially open position of the leaf relative to the frame, irrespective of the starting position of the movement of the leaf relative to the frame.

To that end, the present invention relates to a method for controlling the operation of a motorized drive device of a sliding window for a building,

- the sliding window comprising:
  - a frame,
  - at least one leaf,
  - a device for locking the leaf relative to the frame in a locked partially open position, the locked partially position being arranged between an open position and a closed position of the leaf relative to the frame,
- the motorized drive device being configured to move the leaf by sliding relative to the frame,
- the motorized drive device comprising:
  - an electromechanical actuator, the electromechanical actuator comprising an electronic control unit and an electric motor,
- the locking device comprising:
  - a first subassembly, the first subassembly being fastened on the frame,
  - a second subassembly, the second subassembly being fastened on the leaf, the second subassembly being configured to cooperate with the first subassembly, during a movement of the leaf relative to the frame, so as to be able to lock the leaf relative to the frame in the locked partially open position.

According to the invention, the locked partially open position of the leaf relative to the frame corresponds to a locked position of the second subassembly relative to the first subassembly.

The method comprises at least the following step, carried out during a configuration phase of the motorized drive device:

- determining reference positions of the second subassembly relative to the first subassembly.

These reference positions comprise at least one docking position of the second subassembly relative to the first subassembly, the docking position being arranged before the locked partially open position of the leaf relative to the frame, in the opening movement direction of the leaf relative to the frame.

The method further comprises at least the following steps, carried out during a command phase of the motorized drive device:

- reception of a movement command order by the electronic control unit of the electromechanical actuator,
- moving the leaf relative to the frame at a first speed input or a second speed input, based on the received movement command order, at least one previous executed movement command order and the position of the second subassembly relative to the first subassembly, according to the determined reference positions, the second movement speed input being less than the first movement speed input.

Furthermore, when a command order to move to the locked partially open position is received by the electronic control unit, the movement of the leaf relative to the frame comprises a first movement in the direction closing the leaf relative to the frame implemented at the second speed input, so as to move the second subassembly relative to the first subassembly to the docking position, then a second movement in the opening direction of the leaf relative to the frame implemented at the second speed input, so as to move the second subassembly relative to the first subassembly from the docking position to the locked position.

Thus, the motorized drive device of the sliding window makes it possible to move the leaf relative to the frame in a motorized manner, and to reach the locked partially open position of the leaf relative to the frame, irrespective of the starting position of the movement of the leaf relative to the frame, while adapting the movement speed input of the leaf relative to the frame as a function of the operating conditions.

Furthermore, the motorized drive device of the sliding window makes it possible to reach the locked partially open position of the leaf relative to the frame, irrespective of the starting position of the second subassembly relative to the first subassembly of the locking device.

Additionally, the motorized drive device is configured to determine the reference positions of the second subassembly relative to the first subassembly of the locking device, and to determine the position of the second subassembly relative to the first subassembly, according to the determined reference positions.

According to one preferred feature of the invention, the reference positions of the second subassembly relative to the first subassembly also comprise at least:

- a first unlocked position of the second subassembly relative to the first subassembly, in which the second subassembly is positioned before the first subassembly, in the closing movement direction of the leaf relative to the frame.

According to one advantageous feature of the invention, when the position of the second subassembly relative to the first subassembly is past the first unlocked position, in the opening movement direction of the leaf relative to the frame, the movement of the leaf relative to the frame comprises a preliminary movement in the closing direction of the leaf relative to the frame, before the first movement, implemented at the first speed input, so as to move the second subassembly relative to the first subassembly to the first unlocked position.

According to another advantageous feature of the invention, the reference positions of the second subassembly relative to the first subassembly also comprise at least:

- a second unlocked position of the second subassembly relative to the first subassembly, in which the second subassembly is positioned before the first subassembly, in the opening movement direction of the leaf relative to the frame.

According to another advantageous feature of the invention, when the position of the second subassembly relative to the first subassembly is aligned with or past the second unlocked position, in the closing movement direction of the leaf relative to the frame, the movement of the leaf relative to the frame comprises a preliminary movement in the opening direction of the leaf relative to the frame, before the first movement, implemented at the first speed input, so as to move the second subassembly relative to the first subassembly to the first unlocked position.

According to another advantageous feature of the invention, when the position of the second subassembly relative to the first subassembly is between the second unlocked position and the first unlocked position and the second subassembly is arranged opposite a side of the first subassembly comprising only a sliding ramp of the second subassembly along the first subassembly, the movement of the leaf relative to the frame comprises a preliminary movement in the opening direction of the leaf relative to the frame, before the first movement, implemented at the first speed input, so as to move the second subassembly relative to the first subassembly to the first unlocked position.

According to another advantageous feature of the invention, when the position of the second subassembly relative to the first subassembly is undetermined, the movement of the leaf relative to the frame comprises a first preliminary movement in the closing direction of the leaf relative to the frame implemented at the first speed input, so as to move the second subassembly relative to the first subassembly to the second unlocked position, then a second preliminary movement in the opening direction of the leaf relative to the frame implemented at the first speed input, so as to move the second subassembly relative to the first subassembly to the first unlocked position, the first and second preliminary movements being implemented before the first movement.

According to another advantageous feature of the invention, after reaching the locked position, the movement of the leaf relative to the frame comprises a withdrawal movement along the closing direction of the leaf relative to the frame implemented at the second speed input, so as to limit the stresses exerted by the second subassembly on the first subassembly.

According to another advantageous feature of the invention, after reaching the locked position, the method comprises a step for keeping the leaf in position relative to the frame using a brake of the electromechanical actuator.

Other particularities and advantages of the invention will also appear in the description below.

In the appended drawings, provided as non-limiting examples:

Figure 1:
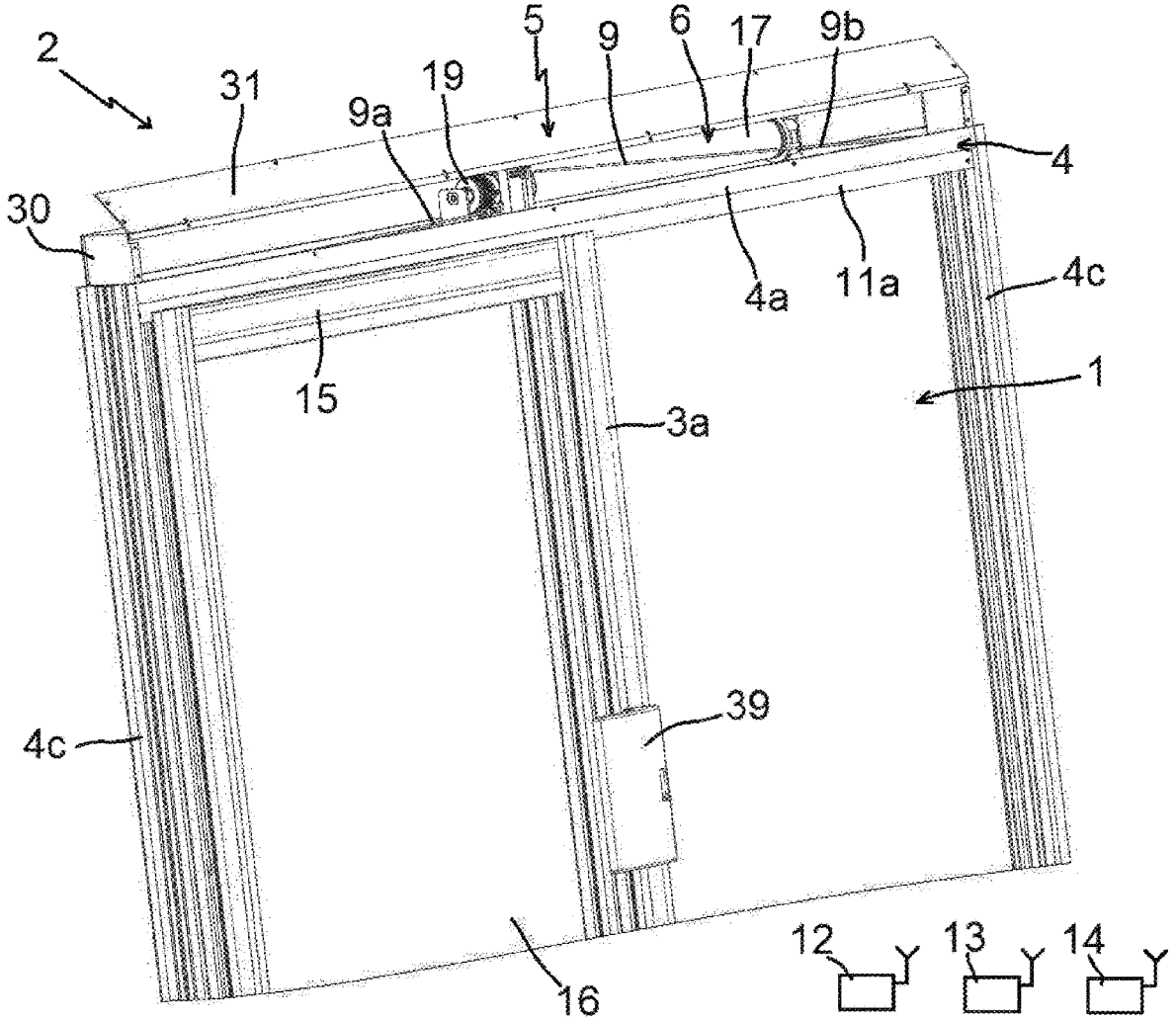
FIG. 1 is a partial schematic perspective view of the sliding window according to an embodiment of the invention, where a first leaf is in an open position relative to a frame and where an access hatch for a box housing a motorized drive device is in the open position.
Figure 2:
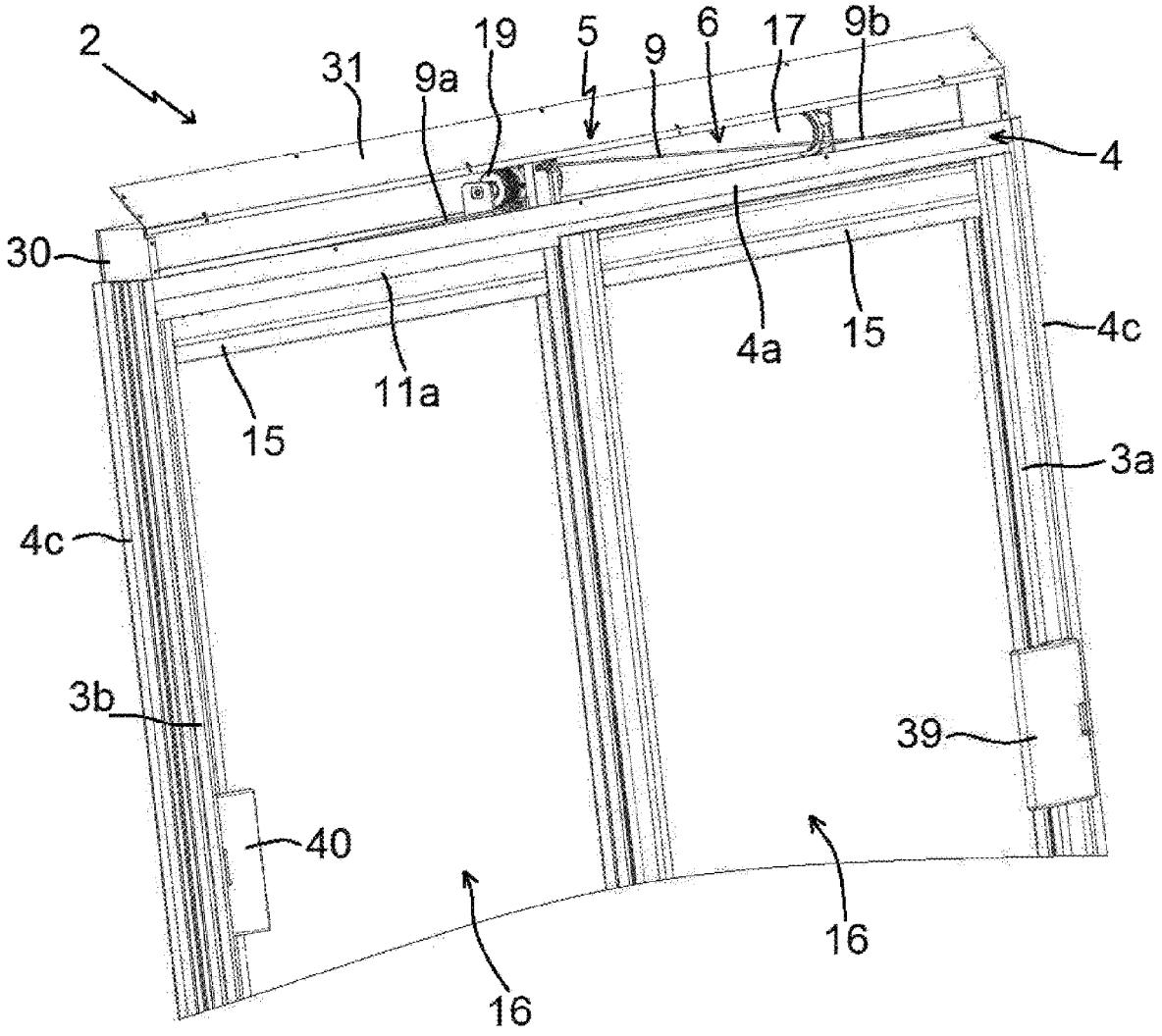
FIG. 2 is a view similar to FIG. 1, where the leaf is in a closed position relative to the frame.
Figure 3:
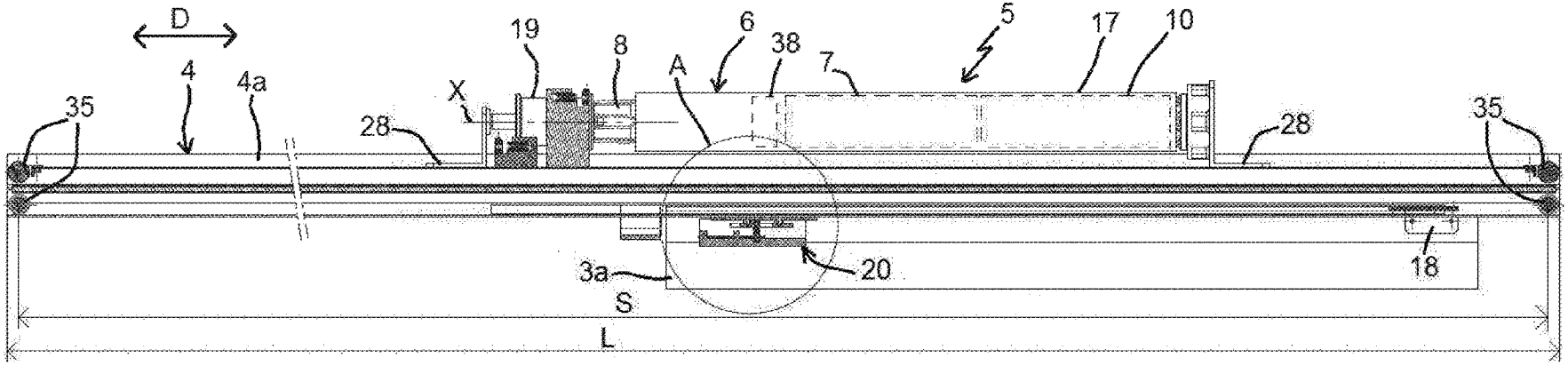
FIG. 3 is a schematic partial and vertical sectional view of the motorized drive device of the window illustrated in FIGS. 1 and 2.

First described, in reference to FIGS. 1 to 3, is a home automation system according to the invention and installed in a building including an opening 1, in which a sliding window 2, also according to the invention, is arranged.

The sliding window 2 can also be called sliding pocket.

The present invention applies to sliding windows and sliding patio doors, which may or may not be equipped with transparent glazing.

The window 2 comprises at least one leaf 3*a*, 3*b* and a frame 4.

Here, and as illustrated in FIGS. 1 and 2, the window 2 comprises a first leaf 3*a* and a second leaf 3*b*.

The window 2 also comprises a motorized drive device 5 for moving the leaf 3*a* by sliding relative to the frame 4.

Here, the motorized drive device 5 is configured to move only one of the first and second leaves 3*a*, 3*b* by sliding relative to the frame 4, namely the first leaf 3*a*.

Here, and as illustrated in FIGS. 1 and 2, the second leaf 3*b* is movable manually, in particular by the user exerting a force on the handle 40 of the second leaf 3*b*. Alternatively, the second leaf 3*b* is stationary.

The number of leaves of the window is not limiting and can be different, in particular equal to three.

Each leaf 3*a*, 3*b* comprises a frame 15. Each leaf 3*a*, 3*b* may also comprise at least one glass sheet 16 arranged in the frame 15.

The number of glass sheets of the leaf is not limiting and can be different, in particular equal to two or more.

The window 2 also comprises a bracket system arranged between the frame 4 and each leaf 3*a*, 3*b*.

The bracket system of a window is well known by those skilled in the art and does not need to be described in more detail here. The bracket system of the window 2 is not shown in FIGS. 1 and 2, so as to facilitate the reading of said figures.

The frame 4 includes an upper crosspiece 4*a*, a lower crosspiece, not shown, and two lateral uprights 4*c*, in the assembled configuration of the window 2 with respect to the building, as illustrated in FIGS. 1 and 2.

The upper crosspiece 4*a*, the lower crosspiece and the two lateral uprights 4*c* of the frame 4 respectively have an inner face and at least one outer face.

The inner face of the upper crosspiece 4*a*, the lower crosspiece and the two lateral uprights 4*c* of the frame 4 is oriented toward the inside of the window 2 and, in particular, toward an outer rim of the frame 15 of each leaf 3*a*, 3*b*.

The outer face of the upper crosspiece 4*a*, the lower crosspiece and the two lateral uprights 4*c* of the frame 4 is oriented toward the outside of the window 2.

The bracket system of the sliding window 2 makes it possible to slide each leaf 3*a*, 3*b* relative to the frame 4 along a sliding direction D, in the example horizontal, in the assembled configuration of the window 2 relative to the building, as illustrated in FIGS. 1 to 3.

The upper crosspiece 4*a* of the frame 4 comprises a sliding rail 11*a* of the leaf 3*a* and a sliding rail, not shown, of the leaf 3*b*. The lower crosspiece of the frame 4 also comprises two sliding rails, respectively for the first leaf 3*a* and the second leaf 3*b*.

Thus, each of the upper 4*a* and lower crosspieces of the frame 4 comprises a first sliding rail 11*a* or equivalent of the first leaf 3 and a second sliding rail of the second leaf 3*b*.

In this way, the first and second leaves 3*a*, 3*b* are configured to move respectively along first and second sliding rails and the like.

In practice, the first and second sliding rails are arranged parallel to one another. Furthermore, the first and second sliding rails are offset relative to one another along the thickness of the frame 4.

The window 2 comprises sliding elements, not shown, allowing the movement of each leaf 3*a*, 3*b* relative to the frame 4. The sliding elements are arranged inside the first and second sliding rails of the lower crosspiece.

In practice, the sliding elements comprise casters arranged below the first and second leaves 3*a*, 3*b*. The casters are configured to roll inside the first and second sliding rails of the lower crosspiece.

An open position by partial or maximal sliding of each leaf 3*a*, 3*b* relative to the frame 4 corresponds to an aeration position of the building.

The motorized drive device 5 makes it possible to move the first leaf 3*a*, automatically by sliding, relative to the frame 4, in particular between the maximum opening position by sliding of the first leaf 3*a* relative to the frame 4 and the closed position of the first leaf 3*a* relative to the frame 4.

The motorized drive device 5 is more particularly visible in FIG. 3. The latter comprises an electromechanical actuator 6, of the tubular type. The electromechanical actuator 6 comprises an electric motor 7 and an output shaft 8. The rotation axis X of the output shaft 8 is parallel to the sliding direction D of the first leaf 3*a* relative to the frame 4 and, in the present case, the second leaf 3*b* relative to the frame 4.

The electric motor 7 of the electromechanical actuator 6 is of the variable speed type. The electric motor 7 is configured to rotate the drive shaft 8 according to at least a first rotation speed input and a second rotation speed input, such that the movement of the first leaf 3*a* relative to the frame 4 is carried out either at a first speed or at a second speed.

Here, the electric motor 7 is of the brushless DC type with electronic switching, called "BLDC" (BrushLess Direct Current), or said to be synchronous with permanent magnets.

The electromechanical actuator 6 is arranged on a stationary part relative to the window 2, in particular relative to the frame 4.

The electromechanical actuator 6 may also comprise a gear reduction device, not shown.

Advantageously, the electromechanical actuator 6 may also comprise a brake 38.

Advantageously, the electric motor 7, the gear reduction device and the brake 38 are positioned inside a casing 17 of the electromechanical actuator 6.

The brake 38 and the electromechanical actuator 6 are configured to block the rotation of the output shaft 8.

As a non-limiting example, the brake may be a spring-operated brake, a cam-actuated brake or an electromagnetic brake.

The electromechanical actuator 6 also comprises an end-of-travel and/or obstacle detection device, not shown. This detection device may be mechanical or electronic.

In the example embodiment illustrated in FIGS. 1 to 3, the motorized drive device 5 also comprises a flexible element 9. The flexible element 9 is moved by the electrochemical actuator 6. The flexible element 9 comprises a first strand 9*a* and a second strand 9*b*, as illustrated in FIGS. 1 and 2. For the clarity of the drawing, the flexible element 9 is not shown in FIG. 3.

The flexible element 9 may have a circular section.

The section of the flexible element is not limiting and may be different, in particular square, rectangular or oval.

In practice, the flexible element 9 is a cable or a cord.

It may be made from a synthetic material, for example nylon or polyethylene with a very high molar mass.

Thus, the use of a flexible element 9 made from a synthetic material makes it possible to minimize the diameter of pulleys of the motorized drive device 5.

The material of the flexible element is not limiting and may be different. In particular, it may be a steel.

The motorized drive device 5 comprises a carriage 18, as illustrated in FIG. 3. The carriage 18 is, on the one hand, attached on the first leaf 3*a* and, on the other hand, connected to the flexible element 9.

Advantageously, the carriage 18 is arranged at least in part along the first sliding rail 11*a* of the upper crosspiece 4*a* of the frame 4.

In practice, the carriage 18 is attached on the first leaf 3*a* using fasteners, in particular screws, not shown.

The motorized drive device 5 comprises a winding pulley 19 of the flexible element 9. The winding pulley 19 is rotated by the output shaft 8 of the electromechanical actuator 6. One end of the first strand 9*a* of the flexible element 9 is connected to a first part of the winding pulley 19. One end of the second strand 9*b* of the flexible element 9 is connected to a second part of the winding pulley 19.

Advantageously, the end of each of the first and second strands 9*a*, 9*b* of the flexible element 9 is respectively attached to the first part or to the second part of the winding pulley 19 using fasteners, not shown.

Thus, the end of each of the first and second strands 9*a*, 9*b* of the flexible element 9 is respectively fastened directly to the first part or to the second part of the winding pulley 19.

In practice, the fasteners of the end of each of the first and second strands 9*a*, 9*b* of the flexible element 9 are cable-clamp elements.

Here, these fasteners are screws, in particular of the self-tapping type, screwing into the winding pulley 19, so as to attach the first and second strands 9*a*, 9*b* of the flexible element 9 by jamming between the head of the screws and the winding surface of the flexible element 9 of the winding pulley 19.

The winding, respectively unwinding, direction of the first strand 9*a* of the flexible element 9 around the first part of the winding pulley 19 is opposite the winding, respectively unwinding, direction of the second strand 9*b* of the flexible element 9 around the second part of the winding pulley 19.

Thus, during the movement of the first leaf 3*a* relative to the frame 4 in a first sliding direction, in particular during the movement from the closed position toward an open position of the first leaf 3*a* relative to the frame 4, the first strand 9*a* of the flexible element 9 winds around the first part of the winding pulley 19, while the second strand 9*b* of the flexible element 9 unwinds around the second part of the winding pulley 19.

Furthermore, during the movement of the first leaf 3*a* relative to the frame 4 in a second sliding direction, in particular during the movement from an open position toward the closed position of the first leaf 3*a* relative to the frame 4, the first strand 9*a* of the flexible element 9 unwinds around the first part of the winding pulley 19, while the second strand 9*b* of the flexible element 9 winds around the second part of the winding pulley 19.

The second sliding direction of the first leaf 3*a* relative to the frame 4 is opposite the first sliding direction.

In this way, the rotational driving direction of the first strand 9*a* of the flexible element 9 around the first part of the winding pulley 19 is opposite the rotational driving direction of the second strand 9*b* of the flexible element 9 around the second part of the winding pulley 19.

Control means of the electromechanical actuator 6, allowing the sliding movement of the first leaf 3*a* relative to the frame 4, comprise at least one electronic control unit 10. The electronic control unit 10 is configured to operate the electric motor 7 of the electromechanical actuator 6 and, in particular, to allow the supply of electricity to the electric motor 7.

Thus, the electronic control unit 10, in particular, commands the electric motor 7, so as to open or close the first leaf 3*a* relative to the frame 4 by sliding.

In this way, the window 2 comprises the electronic control unit 10. More particularly, the electronic control unit 10 is integrated into the motorized drive device 5.

Advantageously, the motorized drive device 5 is a sub-assembly preassembled before mounting, in the example on the frame 4, which comprises at least the electromechanical actuator 6, the winding pulley 19, the flexible element 9 and the electronic control unit 10.

The motorized drive device 5 is controlled by a control unit. The control unit may for example be a local control unit 12.

The local control unit 12 may be connected through a wired or wireless connection with a central control unit 13. The central control unit 13 drives the local control unit 12, as well as other similar local control units distributed throughout the building.

The electronic control unit 10 also comprises an order receiving module, in particular for radioelectric orders sent by an order transmitter, such as the local control unit 12 or the central control unit 13, said orders being intended to control the motorized drive device 5. The order receiving module can also allow the reception of orders sent by wired means.

The electronic control unit 10, the local control unit 12 and/or the central control unit 13 can be in communication with one or several sensors configured to determine, for example, a temperature, a hygrometry, a wind speed, a measurement of an indoor or outside air quality or a presence.

The central control unit 13 may also be in communication with a server 14, so as to control the electromechanical actuator 6 according to data made available remotely via a communication network, in particular an Internet network that may be connected to the server 14.

The electronic control unit 10 may be controlled from the local control unit 12. The local control unit 12 is provided with a control keyboard. The control keyboard of the local control unit 12 comprises selection elements and, optionally, display elements.

As non-limiting examples, the selection elements may be pushbuttons or sensitive keys, the display elements may be light-emitting diodes, an LCD (Liquid Crystal Display) or TFT (Thin Film Transistor) display. The selection and display elements may also be produced using a touch-sensitive screen.

The local control unit 12 may be a stationary or nomad control point. A stationary control point corresponds to a control unit intended to be attached on a facade of a wall of the building, or on a face of the frame 4 of the window 2. A nomad control point corresponds to a remote control intended to be held in a user's hand.

The local control unit 12 allows direct control of the electronic control unit 10 based on a selection made by the user.

The local control unit 12 allows the user to intervene directly on the electromechanical actuator 6 of the motorized drive device 5 using the electronic control unit 10 associated with said motorized drive device 5, or to intervene directly on the electromechanical actuator 6 of the motorized drive device 5 using the central control unit 13.

The motorized drive device 5, in particular the electronic control unit 10, is, preferably, configured to carry out closing command orders by sliding as well as opening by sliding of the first leaf 3*a* relative to the frame 4, said command orders being able to be emitted, in particular, by the local control unit 12 or by the central control unit 13.

The electronic control unit 10 is thus configured to operate the electromechanical actuator 6 of the motorized drive device 5 and, in particular, to allow the supply of electricity to the electromechanical actuator 6.

Here, and as illustrated in FIG. 3, the electronic control unit 10 is positioned inside the casing 17 of the electromechanical actuator 6.

The control means of the electromechanical actuator 6 comprise hardware and/or software means.

As one non-limiting example, the hardware means may comprise at least one microcontroller.

Advantageously, the local control unit 12 comprises a sensor measuring at least one parameter of the environment inside the building and integrated into said unit.

Thus, the local control unit 12 can communicate with the central control unit 13 and the central control unit 13 can control the electronic control unit 10 associated with the motorized drive device 5 based on data coming from the sensor measuring the parameter of the environment inside the building.

Moreover, the local control unit 12 can directly control the electronic control unit 10 associated with the motorized drive device 5 based on data coming from the sensor measuring the parameter of the environment inside the building.

As non-limiting examples, one parameter of the environment inside the building measured by the sensor integrated into the local control unit 12 is the humidity, the temperature, the carbon dioxide level or the level of a volatile organic compound in the air.

Preferably, the activation of the local control unit 12 by the user has priority relative to the activation of the central control unit 13, so as to control the closing and opening by sliding of the first leaf 3*a* relative to the frame 4.

Thus, the activation of the local control unit 12 directly controls the electronic control unit 10 associated with the motorized drive device 5 based on a selection made by the user, optionally inhibiting a control order that may be sent by the central control unit 13 or ignoring a value measured by a sensor measuring at least one parameter of the environment inside the building or outside the building, or a presence detection signal inside the building.

Here, the motorized drive device 5, in particular the electromechanical actuator 6, is supplied with electricity from an electricity supply grid. In such a case, the electromechanical actuator 6 comprises a power cable, not shown, allowing it to be supplied with electricity from the electricity supply grid of the sector.

Alternatively, the motorized drive device 5, in particular the electromechanical actuator 6, is supplied with electricity using a battery, not shown. In such a case, the battery can be recharged, for example, by a photovoltaic panel or any other energy recovery system, in particular of the thermal type.

Preferably, the electromechanical actuator 6 is attached on the upper crosspiece 4*a* of the frame 4 using fasteners 28.

Thus, the motorized drive device 5 is configured to be implemented on a sliding window 2 comprising a frame 4 provided with an upper crosspiece compatible with the fasteners 28 and standards lower crosspiece and lateral uprights 4*c*.

Furthermore, the winding pulley 19 is maintained on the upper crosspiece 4*a* through same fasteners 28.

In practice, the fasteners 28 of the electromechanical actuator 6 on the upper crosspiece 4*a* of the frame 4 comprise supports, in particular fastening brackets.

Advantageously, these supports 28 are fastened on the upper crosspiece 4*a* of the frame 4 by screwing.

Here, the fasteners 28 of the electromechanical actuator 6 on the upper crosspiece 4*a* of the frame 4 comprise two supports. A first support 28 is assembled at a first end of the electromechanical actuator 6. A second support 28 is assembled at a second end of the electromechanical actuator 6. The first end of the electromechanical actuator 6 is opposite the second end of the electromechanical actuator 6.

Here, the flexible element 9 of the motorized drive device 5 extends along the upper crosspiece 4*a* of the frame 4 from the first part of the winding pulley 19 to the second part of the winding pulley 19.

Thus, such an arrangement of the flexible element 9 makes it possible to guarantee the movements by sliding of the first leaf 3*a* relative to the frame 4, as well as the esthetic appearance of the window 2.

Here, the flexible element 9 extends, on the one hand, from the side of the upper face of the upper crosspiece 4*a* and, on the other hand, from the side of a lower face of the upper crosspiece 4*a*, along at least part of the length L of the upper crosspiece 4*a* of the frame 4.

In practice, the motorized drive device 5 comprises at least two angle transmission pulleys 35, the respective centers of which are separated by a determined distance S along the length L of the upper crosspiece 4*a*.

At least a first angle transmission pulley 35 is arranged on a first side of the electromechanical actuator 6, i.e. the first end of the electromechanical actuator 6. At least a second angle transmission pulley 35 is arranged on a second side of the electromechanical actuator 6, i.e. the second end of the electromechanical actuator 6.

Here, the motorized drive device 5 comprises two pairs of angle transmission pulleys 35 separated by the determined distance S.

The number of angle transmission pulleys is not limiting and may be different.

Advantageously, the determined distance S between the angle transmission pulleys 35 is different from the sliding movement travel of the first leaf 3*a*.

Each angle transmission pulley 35 can, for example, be made by a loose pulley, in other words mounted freely rotating, in particular on the upper crosspiece 4*a* of the frame 4, or by a stationary pulley, in other words secured to its axis, in particular fastened on the upper crosspiece 4*a* of the frame 4.

As illustrated in FIGS. 1 and 2, the electromechanical actuator 6 and the winding pulley 19 are positioned in a box 30 arranged above the window 2, in particular extending above the upper crosspiece 4*a* of the frame 4.

Thus, the electromechanical actuator 6 and the winding pulley 19 are hidden in the box 30, so as to guarantee the esthetically pleasing appearance of the sliding window 2.

Advantageously, the window 2 comprises an access hatch 31 to the motorized drive device 5 and, more particularly, to the electromechanical actuator 6 and the winding pulley 19.

Thus, the access hatch 31 makes it possible to perform a maintenance operation of the motorized drive device 5 and/or a repair operation thereof.

Here and as illustrated in FIGS. 1 and 2, the access hatch 31 extends over the entire length L of the upper crosspiece 4*a* of the frame 4.

Alternatively, the access hatch 31 extends only over part of the length L of the upper crosspiece 4*a* of the frame 4.

Here and as illustrated in FIGS. 1 and 2, the access hatch 31 is arranged in the box 30.

Alternatively, the access hatch 31 is arranged in the upper crosspiece 4*a* of the frame 4, in particular through the first sliding rail 11*a* of the upper crosspiece 4*a* or between the first and second sliding rails of the upper crosspiece 4*a*.

Advantageously, the only leaf 3*a*, from among the first and second leaves 3*a*, 3*b*, that is able to be slid by the motorized drive device 5, is an interior leaf of the window 2. The interior leaf 3*a* is arranged on the interior side relative to the building, in the assembled configuration of the window 2 in the building.

Thus, the flexible element 9 allowing the driving by sliding of the first leaf 3*a* relative to the frame 4 is kept inaccessible from the outside of the building and, more particularly, of the window 2, when the first leaf 3*a* is in a closed or secured ventilation position relative to the frame 4.

The secured ventilation position, in other words a locked partially open position, is a position of the first leaf 3*a* relative to the frame 4 in which the first leaf 3*a* is ajar relative to the frame 4 and kept locked by a locking device 20. The locked partially open position is arranged between the open position and the closed position of the first leaf 3*a* relative to the frame 4.

The locked partially open position is a position of the first leaf 3*a* partway open relative to the frame 4, for which the frame 15 of the first leaf 3*a* is moved away from the frame 4 by a predetermined distance, in particular around several centimeters.

Furthermore, in the case where the second leaf 3*b* is movable manually, the latter can be moved by the user independently of the first leaf 3*a*, in particular if there is no power supply of the motorized drive device 5 or a failure of the motorized drive device 5.

The motorized drive device 5 makes it possible to slide the first leaf 3*a* automatically relative to the frame 4 along the sliding direction D, by winding, respectively unwinding, the first strand 9*a* of the flexible element 9 around the first part of the winding pulley 19 and unwinding, respectively winding, the second strand 9*b* of the flexible element 9 around the second part of the winding pulley 19.

The motorized drive device 5 makes it possible to close and open the first leaf 3*a* in a motorized manner relative to the frame 4, by sliding along the sliding direction D.

Advantageously, in case of failure of the motorized drive device 5, a manual sliding, in particular by the user, of the first leaf 3*a* relative to the frame 4 along the sliding direction D can be implemented, following the separation of the flexible element 9 relative to the first leaf 3*a*.

Furthermore, the use of the flexible element 9 to move the first leaf 3*a* relative to the frame 4 makes it possible to minimize the costs of obtaining the motorized drive device 5, and to minimize the bulk of the motorized drive device 5, in particular relative to a belt.

The motorized drive device 5 can be controlled by the user, for example by receiving a command order corresponding to pressing on a selection element of the local control unit 12.

The motorized drive device 5 can also be controlled automatically, for example by receiving a command order corresponding to at least one signal coming from at least one sensor and/or to a signal coming from a clock. The sensor and/or the clock can be integrated into the local control unit 12 or the central control unit 13.

Advantageously, the motorized drive device 5 makes it possible to move the first leaf 3*a* automatically by sliding relative to the frame 4 to a predetermined position, between the closed position and the maximal opened position. The movement by sliding of the first leaf 3*a* relative to the frame 4 to the predetermined position, in particular partial opening or closing, is carried out after receiving a command order emitted by the local control unit 12, the central control unit 13 or a sensor.

Here, a movement by sliding of the first leaf 3 relative to the frame 4 in the sliding direction D is carried out by supplying electricity to the electromechanical actuator 6, so as to unwind and wind the first and second strands 9*a*, 9*b* of the flexible element 9 around the first and second parts of the winding pulley 19.

Thus, the unwinding and winding of the first and second strands 9*a*, 9*b* of the flexible element 9 around the first and second parts of the winding pulley 19 is controlled by supplying electricity to the electromechanical actuator 6.

In practice, the supply of electricity to the electromechanical actuator 6 is controlled by a command order received by the electronic control unit 10 coming from the local control unit 12, the central control unit 13 or a sensor.

The motorized drive device 5 is configured to operate at least in a control mode and a configuration mode.

In reference to FIGS. 3 to 7, we will now describe the locking device 20 of the sliding window 2.

The locking device 20 comprises a first subassembly 21 and a second subassembly 22. The first subassembly 21 is fastened on the frame 4, using fasteners, not shown, in particular by screwing. The second subassembly 22 is fastened on the first leaf 3*a*, using fasteners, not shown, in particular by screwing.

The type of fasteners of the first and second subassemblies 21, 22, respectively on the frame 4 and on the first leaf 3*a*, is not limiting and may be different. These may, in particular, involve fasteners by resilient snapping.

Figure 4:
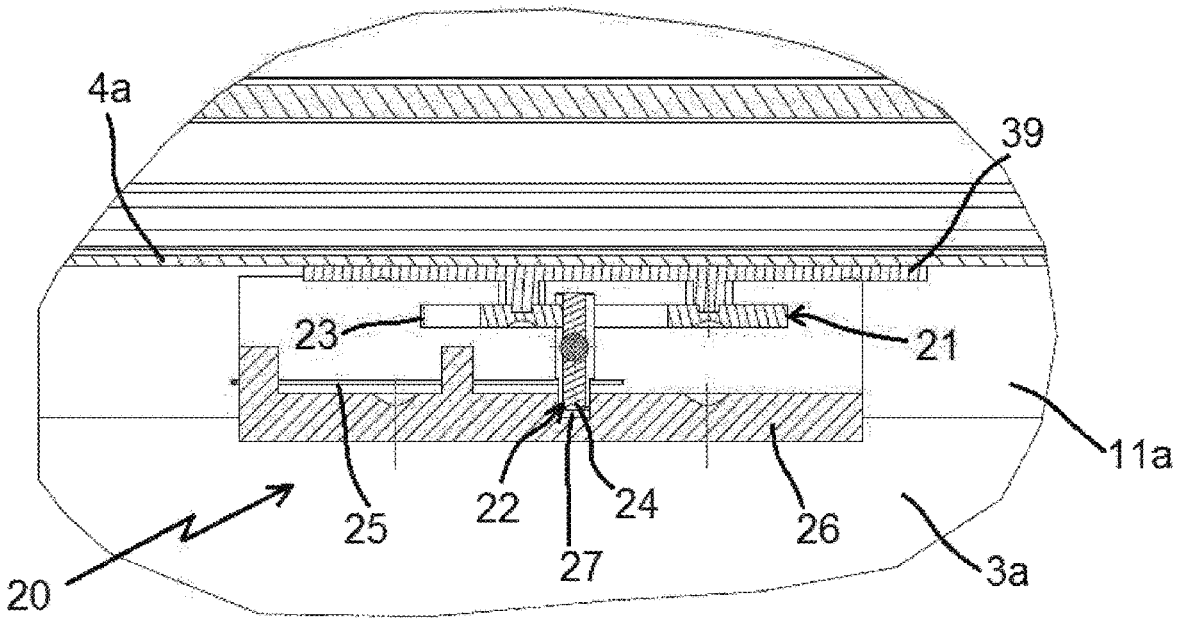
FIG. 4 is an enlarged view of detail A of FIG. 3, illustrating a device for locking the window.
Figure 5:
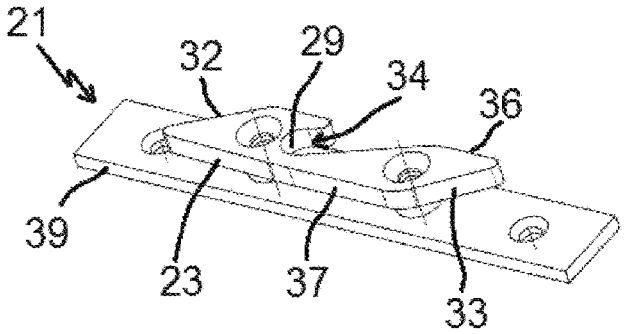
FIG. 5 is a schematic perspective view of a first subassembly of the locking device illustrated in FIG. 4.
Figure 6:
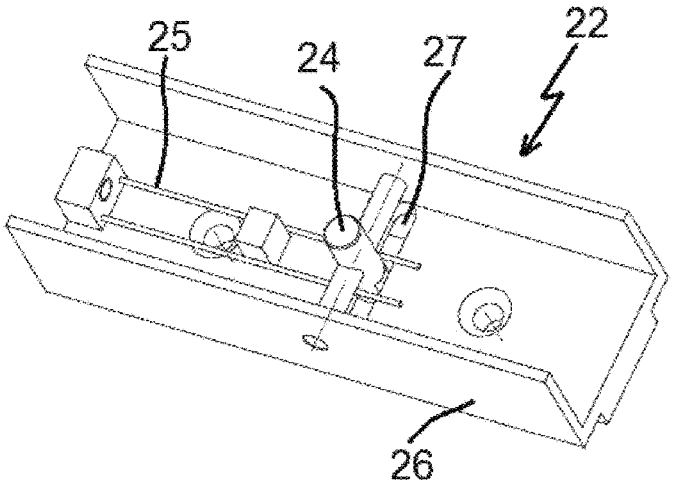
FIG. 6 is a schematic perspective view of a second subassembly of the locking device illustrated in FIG. 4.

In FIG. 5, the first fastening subassembly 21 is shown in perspective seen from below relative to its mounted configuration shown in FIG. 4. In FIG. 6, the second subassembly 22 is shown in perspective view seen from above.

The second subassembly 22 is configured to cooperate with the first subassembly 21, during a movement of the first leaf 3*a* relative to the frame 4, so as to be able to lock the first leaf 3*a* relative to the frame 4 in the locked partially open position.

The locking device 20 is configured to be actuated using the motorized drive device 5.

Thus, the locking device 20 makes it possible to prevent moving the first leaf 3*a* manually relative to the frame 4 toward the open position, when the first leaf 3*a* is in the locked partially open position relative to the frame 4.

Here, the locking device 20 is positioned inside the first sliding rail 11*a*.

Thus, the positioning of the locking device 20 inside the first sliding rail 11*a* makes it possible to guarantee the safety of the locking device 20, since the latter is inaccessible, when the first leaf 3*a* is in the locked partially open position relative to the frame 4.

Furthermore, the positioning of the locking device 20 inside the first sliding rail 11*a* makes it possible to guarantee the esthetic appearance of the window 2, since the locking device 20 is hidden in the first sliding rail 11*a*.

In the example embodiment illustrated in FIGS. 4 to 7, the first subassembly 21 comprises at least one cam 23. Furthermore, the second subassembly 22 comprises at least one pin 24.

Here, the locking device 20 is a mechanical device.

In practice, the first subassembly 21 comprises a support 39. Furthermore, the second subassembly 22 also comprises a support 26. Furthermore, the pin 24 is mounted inside the support 26.

Advantageously, the second subassembly 22 also comprises a return spring 25.

The return spring 25 is configured to cooperate with the pin 24.

Thus, the return spring 25 makes it possible to guarantee that the pin 24 follows the cam profile 23.

In practice, the pin 24 is engaged inside a groove 27 arranged in the support 26. Furthermore, the return spring 25 makes it possible to guarantee the resilient return of the pin 24 toward an idle position, in particular median, along the groove 27 of the support 26.

Here and as illustrated in FIGS. 4 and 6, the return spring 25 is a leaf spring.

The type of return spring of the second subassembly is not limiting and can be different. This may, in particular, involve a spiral spring.

Figure 7:
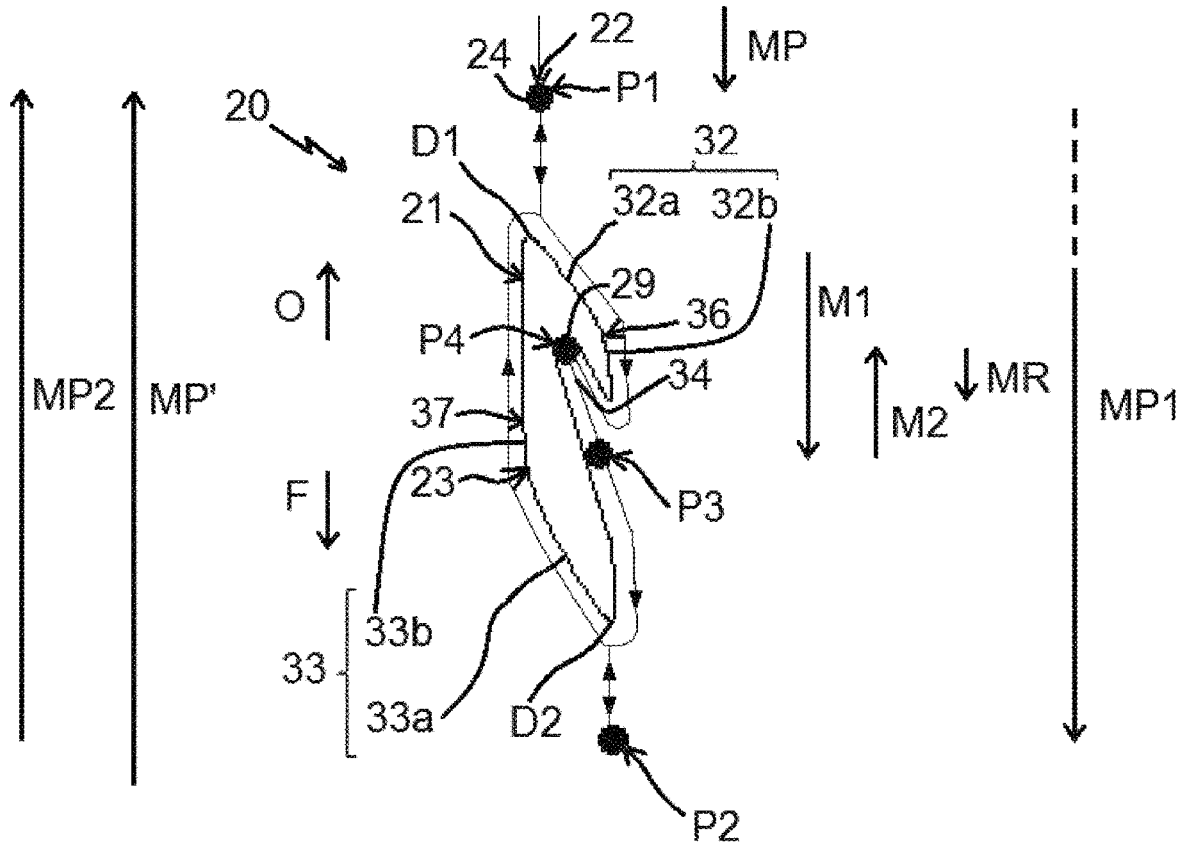
FIG. 7 is a schematic view illustrating the path of a pin of the first subassembly relative to a cam of the second subassembly.

In reference to FIGS. 4 to 7, we will now describe an embodiment of a method for controlling the operation of the motorized drive device 5 of the sliding window 2 illustrated in FIGS. 1 to 3. In FIG. 7, the thin line on which arrows are superimposed represents the trajectory of the pin 24 around the cam 23.

During a configuration phase of the motorized drive device 5, the method comprises a step for determining reference positions P1, P2, P3 of the second subassembly 22 relative to the first subassembly 21.

The reference positions P1, P2, P3 of the second subassembly 22 relative to the first subassembly 21 comprise at least:

- a first unlocked position P1 of the second subassembly 22 relative to the first subassembly 21, in which the second subassembly 22 is positioned before the first subassembly 21, in the closing movement direction F of the first leaf 3*a* relative to the frame 4,
- a second unlocked position P2 of the second subassembly 22 relative to the first subassembly 21, in which the second subassembly 22 is positioned before the first subassembly 21, in the opening movement direction O of the first leaf 3*a* relative to the frame 4, and
- a docking position P3 of the second subassembly 22 relative to the first subassembly 21, the docking position P3 being arranged before the locked partially open position of the first leaf 3*a* relative to the frame 4, in the opening movement direction O of the first leaf 3*a* relative to the frame 4.

Here, the locked partially open position of the first leaf 3*a* relative to the frame 4 corresponds to a locked position P4 of the second subassembly 22 relative to the first subassembly 21.

The docking position P3 is arranged between the first and second unlocked positions P1, P2.

Furthermore, the docking position P3 is arranged between the locked position P4 and the second unlocked position P2.

The distance between each of the first and second unlocked positions P1, P2 and the docking position P3 is determined, so as to avoid accidental locking of the second subassembly 22 with the first subassembly 21, in particular by adding a safety margin.

Advantageously, the second unlocked position P2 of the second subassembly 22 relative to the first subassembly 21 corresponds to the closed position of the first leaf 3*a* relative to the frame 4.

Here, the cam 23 of the first subassembly 21 comprises a first ramp 32 extending opposite the first unlocked position P1, so as to cooperate with the pin 24 of the second subassembly 22, during a movement of the first leaf 3*a* relative to the frame 4, in the closing movement direction F.

Furthermore, the cam 23 of the first subassembly 21 comprises a second ramp 33 extending opposite the second unlocked position P2, so as to cooperate with the pin 24 of the second subassembly 22, during a movement of the first leaf 3*a* relative to the frame 4, in the opening movement direction O.

Moreover, the cam 23 of the first subassembly 21 comprises a stop 29, in particular with a hook shape, configured to cooperate with the pin 24 of the second subassembly 22, when the second subassembly 22 is in the locked position P4 relative to the first subassembly 21.

Here and as illustrated in FIGS. 5 and 7, the cam 23 of the first subassembly 21 comprises a slit 34. Furthermore, the stop 29 of the cam 23 is arranged at the bottom of the slit 34 of the cam 23.

References 36 and 37 respectively denote two longitudinal sides of the cam 23. These sides are positioned substantially parallel to the directions of opening O and closing F movement.

Advantageously, part of the first ramp 32 of the cam 23 extends along the first side 36 of the cam 23, following only part of the length of said side 36.

Furthermore, part of the second ramp 33 of the cam 23 extends along the second side 37 of the cam 23, following the entire length of said side 37.

Moreover, the slit 34 of the cam 23 emerges on the first side 36 of the cam 23.

Here, the first ramp 32 of the cam 23 extends from a first starting point D1 arranged at a first end of the cam 23, in particular the end of the cam 23 positioned opposite the first unlocked position P1, to an arrival point arranged at an end of the slit 34 of the cam 23, in particular the end of the slit 34 emerging toward the outside of the cam 23, so as to allow the insertion of the pin 24. The first ramp 32 thus comprises a first part 32*a* arranged between the starting point D1 and the first side 36 and a second part 32*b* arranged along a part of the first side 36, above the slit 34, in the illustration of FIG. 7.

The second ramp 33 comprises a first part 33*a* that extends, from a second starting point D2 arranged at a second end of the cam 23 opposite its first end, to the second side 37. The second ramp 33 also comprises a second part 33*b*, which runs over the entire length of the second side 37. The second ramp 33 therefore connects the starting point D2 to the starting point D1.

In one example embodiment, the reference positions P1, P2, P3 of the second subassembly 22 relative to the first subassembly 21 are determined by computation, from the closed position of the first leaf 3*a* relative to the frame 4.

Thus, the reference positions P1, P2, P3 are determined as a function of the distance between the closed position of the first leaf 3*a* relative to the frame 4 and the position of the first subassembly 21 fastened on the frame 4.

Furthermore, the reference positions P1, P2, P3 are determined as a function of the dimensions and shapes of the first subassembly 21 and the second subassembly 22.

In such a case, the method comprises a step for computing reference positions P1, P2, P3, from the closed position of the first leaf 3*a* relative to the frame 4.

In a second example embodiment, the reference positions P1, P2, P3 are determined by learning, in particular from the closed position of the first leaf 3*a* relative to the frame 4.

Thus, the reference positions P1, P2, P3 are determined by movement of the first leaf 3*a* relative to the frame 4.

In another example embodiment, the reference positions P1, P2, P3 are determined, on the one hand, by learning and, on the other hand, by computation.

In such a case, at least one of the reference positions P1, P2, P3 is determined by learning, in particular the docking position P3 of the second subassembly 22 relative to the first subassembly 21, and at least one other of the reference positions P1, P2, P3 is determined by computation, in particular the first and second unlocked positions P1, P2 of the second subassembly 22 relative to the first subassembly 21.

After the step for determining the reference positions P1, P2, P3, the method comprises a step for storing the reference positions P1, P2, P3 by the electronic control unit 10, in particular by a memory of a microcontroller of the electronic control unit 10.

During a command phase of the motorized drive device 5, the method comprises a step for reception of a movement command order by the electronic control unit 10 of the electromechanical actuator 6.

Then, the method comprises a step for moving the first leaf 3*a* relative to the frame 4 at a first speed input V1 or a second speed input V2, based on the received movement command order, at least one previous executed movement command order and the position of the second subassembly 22 relative to the first subassembly 21, according to the determined reference positions P1, P2, P3. The second movement speed input V2 is less than the first movement speed input V1.

Thus, the motorized drive device 5 of the sliding window 2 makes it possible to move the first leaf 3*a* relative to the frame 4 in a motorized manner, and to reach the locked partially open position of the first leaf 3*a* relative to the frame 4, irrespective of the starting position of the movement of the first leaf 3*a* relative to the frame 4, while adapting the movement speed input of the first leaf 3*a* relative to the frame 4 as a function of the operating conditions.

Furthermore, the motorized drive device 5 of the sliding window 2 makes it possible to reach the locked partially open position of the first leaf 3*a* relative to the frame 4, irrespective of the starting position of the second subassembly 22 relative to the first subassembly 21 of the locking device 20.

Moreover, the motorized drive device 5 is configured to determine the reference positions P1, P2, P3 of the second subassembly 22 relative to the first subassembly 21 of the locking device 20, and to determine the position of the second subassembly 22 relative to the first subassembly 21, according to the determined reference positions P1, P2, P3.

Before the step for receiving a movement command order or the step for moving the first leaf 3*a* relative to the frame 4, the method comprises a step for storing the previous command order(s) executed by the electronic control unit 10, in particular by a memory of a microcontroller of the electronic control unit 10.

The movement command orders belong to a list, which comprises at least a movement order to the closed position, a movement order to the open position and a movement order to the locked partially open position. The list may also comprise a movement order to an unlocked partially open position, i.e. either to any intermediate position between the closed position and the open position, or to a predetermined intermediate position between the closed position and the open position.

Before the step for receiving a movement command order or the step for moving the first leaf 3*a* relative to the frame 4, the method comprises a step for determining the position of the second subassembly 22 relative to the first subassembly 21, according to the determined reference positions P1, P2, P3.

The step for determining the position of the second subassembly 22 relative to the first subassembly 21 can be carried out before, after or in parallel with the step for storing the executed previous movement command order(s).

Advantageously, the determination of the position of the second subassembly 22 relative to the first subassembly 21 is implemented using a counting device, not shown. The counting device is configured to cooperate with the electronic control unit 10 of the electromechanical actuator 6.

In one example embodiment, the counting device is of the magnetic type, for example an encoder equipped with Hall effect sensors. Such a counting device may make it possible to determine the number of revolutions performed by a rotor of the electric motor 7 or by the output shaft 8 of the electromechanical actuator 6.

The type of counting device is not limiting and may be different, in particular of the temporal type and made through a microcontroller of the electronic control unit 10.

Following the step for receiving a movement command order and before the step for moving the first leaf 3*a* relative to the frame 4, the method comprises a step for selecting the movement speed V1, V2 of the first leaf 3*a* relative to the frame 4, as a function of the received movement command order, the executed previous movement command order(s) and the position of the second subassembly 22 relative to the first subassembly 21, according to the determined reference positions P1, P2, P3.

When a command order to move to the locked partially open position is received by the electronic control unit 10, the movement of the first leaf 3*a* relative to the frame 4 comprises a first movement M1 in the closing direction F of the first leaf 3*a* relative to the frame 4 implemented at the second speed input V2, so as to move the second subassembly 22 relative to the first subassembly 21 to the docking position P3, then a second movement M2 in the opening direction O of the first leaf 3*a* relative to the frame 4 implemented at the second speed input V2, so as to move the second subassembly 22 relative to the first subassembly 21 from the docking position P3 to the locked position P4.

Thus, during the first movement M1 in the closing direction F of the first leaf 3*a* relative to the frame 4, the movement of the pin 24 of the second subassembly 22 relative to the cam 23 of the first subassembly 21 is implemented along the first ramp 32 of the cam 23. Furthermore, during the second movement M2 in the opening direction O of the first leaf 3*a* relative to the frame 4, the movement of the pin 24 relative to the cam 23 is implemented until the stop 29 of the cam 23, in particular inside the slit 34 of the cam 23.

Moreover, during the first and second movements M1, M2 of the first leaf 3*a* relative to the frame 4, the respective movements of the pin 24 relative to the cam 23 are implemented on the first side 36 of the cam 23.

Additionally, the first and second movements M1, M2 of the first leaf 3*a* relative to the frame 4 are implemented at the second speed input V2, so as to avoid damaging the locking device 20 and to guarantee locking of the first leaf 3*a* relative to the frame 4 in the locked partially open position.

Preferably, the first movement M1 in the closing direction F of the first leaf 3*a* relative to the frame 4 is implemented from the first unlocked position P1 of the second subassembly 22 relative to the first subassembly 21.

Advantageously, the determination of the locked position P4 is done using the obstacle detection device of the electromechanical actuator 6.

Preferably, after reaching the locked position P4, the movement of the first leaf 3*a* relative to the frame 4 comprises a withdrawal movement MR along the closing direction F of the first leaf 3*a* relative to the frame 4 implemented at the second speed input V2, so as to limit the stresses exerted by the second subassembly 22 on the first subassembly 21.

Thus, during the withdrawal movement MR in the closing direction F of the first leaf 3*a* relative to the frame 4, the pin 24 is moved relative to the cam 23 inside the slit 34 of the cam 23, so as no longer to be in contact against the stop 29 of the cam 23.

In this way, the second subassembly 22 does not bear against the first subassembly 21, so as to avoid stressing the window elements 2 and, in particular, the locking device 20 and the motorized drive device 5. The lifetime of the locking device 20 and the motorized drive device 5 of the window 2 is thus improved.

Furthermore, the pin 24 of the second subassembly 22 is kept inside the slit 34 of the cam 23, so as to guarantee the maintenance of the first leaf 3*a* relative to the frame 4 in the locked partially open position.

In practice, the withdrawal movement MR in the closing direction F of the first leaf 3*a* relative to the frame 4 is around several millimeters. This is exaggerated in FIG. 7 in order to be visible.

Additionally, the withdrawal movement MR in the closing direction F of the first leaf 3*a* relative to the frame 4 is implemented at the second speed input V2, so as to avoid damaging the locking device 20 and to guarantee precise positioning of the pin 24 relative to the slit 34 of the cam 23.

Advantageously, after reaching the locked position P4 and, in particular, upon the withdrawal movement MR in the closing direction F of the first leaf 3*a* relative to the frame 4, the method comprises a step for keeping the first leaf 3*a* in position relative to the frame 4 using the brake 38 of the electromechanical actuator 6.

Thus, the pin 24 of the second subassembly 22 is kept inside the slit 34 of the cam 23 using the brake 38 of the electromechanical actuator 6, so as to guarantee the maintenance of the first leaf 3*a* relative to the frame 4 in the locked partially open position.

In this way, the brake 38 makes it possible to prevent moving of the pin 24 relative to the cam 23 in the closing direction F.

When the position of the second subassembly 22 relative to the first subassembly 21 is past the first unlocked position P1, in the opening direction O of the first leaf 3*a* relative to the frame 4, the movement of the first leaf 3*a* relative to the frame 4 comprises a preliminary movement MP in the closing direction F of the first leaf 3*a* relative to the frame 4, before the first movement M1, implemented at the first speed input V1, so as to move the second subassembly 22 relative to the first subassembly 21 to the first unlocked position P1.

Thus, during the preliminary movement MP in the closing direction F of the first leaf 3*a* relative to the frame 4, the movement of the pin 24 of the second subassembly 22 is implemented toward the cam 23 of the first subassembly 21 and, in particular, the first ramp 32 of the cam 23.

Additionally, the preliminary movement MP in the closing direction F of the first leaf 3*a* relative to the frame 4 is implemented at the first speed input V1, without risk of damaging the locking device 20, since the pin 24 is separated from the cam 23, and so as to accelerate reaching the locked partially open position of the first leaf 3*a* relative to the frame 4, in particular reaching of the first unlocked position P1 by the pin 24.

When the position of the second subassembly 22 relative to the first subassembly 21 is aligned with or past the second unlocked position P2, in the closing direction F of the first leaf 3*a* relative to the frame 4, the movement of the first leaf 3*a* relative to the frame 4 comprises a preliminary movement MP' in the opening direction O of the first leaf 3*a* relative to the frame 4, before the first movement M1, implemented at the first speed input V1, so as to move the second subassembly 22 relative to the first subassembly 21 to the first unlocked position P1.

Thus, during the preliminary movement MP' in the opening direction O of the first leaf 3*a* relative to the frame 4, the movement of the pin 24 of the second subassembly 22 is implemented toward the cam 23 of the first subassembly 21, then along the second ramp 33 of the cam 23, up to the starting point D1 of the first ramp 32 of the cam 23.

Additionally, the preliminary movement MP' in the opening direction O of the first leaf 3*a* relative to the frame 4 is implemented at the first speed input V1, without risk of damaging the locking device 20, since the movement of the pin 24 relative to the cam 23 is implemented along the second side 37 of the cam 23, and so as to accelerate reaching the locked partially open position of the first leaf 3*a* relative to the frame 4, in particular reaching of the first unlocked position P1 by the pin 24.

When the position of the second subassembly 22 relative to the first subassembly 21 is between the second unlocked position P2 and the first unlocked position P1 and the second subassembly 22 is positioned opposite the first side 36 of the first subassembly 21, comprising the stop 29 of the cam 23, the movement of the first leaf 3*a* relative to the frame 4 comprises only the first and second movements M1, M2, implemented at the second speed input V2, as previously described.

Advantageously, the determination of the position of the second subassembly 22 along the first side 36 of the first subassembly 21 is implemented by the electronic control unit 10 of the electromechanical actuator 6 as a function of the last command order(s) executed previously by the electronic control unit 10.

When the position of the second subassembly 22 relative to the first subassembly 21 is between the second unlocked position P2 and the first unlocked position P1 and the second subassembly 22 is arranged opposite the second side 37 of the first subassembly 21, comprising only the sliding ramp 33 of the second subassembly 22 along the first subassembly 21, in particular without the stop 29 of the cam 23, the movement of the first leaf 3*a* relative to the frame 4 comprises a preliminary movement MP' in the opening direction O of the first leaf 3*a* relative to the frame 4, before the first movement M1, implemented at the first speed input V1, so as to move the second subassembly 22 relative to the first subassembly 21 to the first unlocked position P1.

Thus, during the preliminary movement MP' in the opening direction O of the first leaf 3*a* relative to the frame 4, the movement of the pin 24 of the second subassembly 22 is implemented along the second ramp 33 of the cam 23, up to the starting point D1 of the first ramp 32 of the cam 23.

Additionally, the preliminary movement MP' in the opening direction O of the first leaf 3*a* relative to the frame 4 is implemented at the first speed input V1, without risk of damaging the locking device 20, since the movement of the pin 24 relative to the cam 23 is implemented along the second side 37 of the cam 23, and so as to accelerate reaching the locked partially open position of the first leaf 3*a* relative to the frame 4, in particular reaching of the first unlocked position P1 by the pin 24.

Advantageously, the determination of the position of the second subassembly 22 along the second side 37 of the first subassembly 21 is implemented by the electronic control unit 10 of the electromechanical actuator 6 as a function of the last command order(s) executed previously by the electronic control unit 10.

When the position of the second subassembly 22 relative to the first subassembly 21 is undetermined, the movement of the first leaf 3*a* relative to the frame 4 comprises a first preliminary movement MP1 in the closing direction F of the first leaf 3*a* relative to the frame 4 implemented at the first speed input V1, so as to move the second subassembly 22 relative to the first subassembly 21 to the second unlocked position P2, then a second preliminary movement MP2 in the opening direction O of the first leaf 3*a* relative to the frame 4 implemented at the first speed input V1, so as to move the second subassembly 22 relative to the first subassembly 21 to the first unlocked position P1. The first and second preliminary movements MP1, MP2 are implemented before the first movement M1, as previously described.

Thus, during the first preliminary movement MP1 in the closing direction F of the first leaf 3*a* relative to the frame 4, the movement of the pin 24 of the second subassembly 22 is implemented, optionally, toward the cam 23 of the first subassembly 21, then along the first ramp 32 of the cam 23 and up to the second unlocked position P2. Furthermore, during the second preliminary movement MP2 in the opening direction O of the first leaf 3*a* relative to the frame 4, the movement of the pin 24 is implemented along the second ramp 33 of the cam 23, up to the starting point D1 of the first ramp 32 of the cam 23.

Additionally, the first preliminary movement MP1 in the closing direction F of the first leaf 3*a* relative to the frame 4 is implemented at the first speed input V1, such that the pin 24 does not engage in the slit 34 of the cam 23 and so as to accelerate reaching the locked partially open position P2 by the pin 24. Furthermore, the second preliminary movement MP2 in the opening direction O of the first leaf 3*a* relative to the frame 4 is implemented at the first speed input V1, without risk of damaging the locking device 20, since the movement of the pin 24 relative to the cam 23 is implemented along the second side 37 of the cam 23, and so as to accelerate reaching the locked partially open position of the first leaf 3*a* relative to the frame 4, in particular reaching of the first unlocked position P1 by the pin 24.

Preferably, in such a case, the second unlocked position P2 corresponds to the closed position of the first leaf 3*a* relative to the frame 4.

The first preliminary movement MP1 in the closing direction F of the first leaf 3*a* relative to the frame 4 is a preliminary movement making it possible to recalibrate the data of the electronic control unit 10 by the positioning of the pin 24 relative to the cam 23 in a predefined position, in particular the second unlocked position P2.

Advantageously, the determination of the second unlocked position P2 is done using the obstacle detection device of the electromechanical actuator 6.

When a movement command order to the open position or the intermediate position is received by the electronic control unit 10 and the position of the second subassembly 22 relative to the first subassembly 21 is:

past the first unlocked position P1, in the opening movement direction O of the first leaf 3*a* relative to the frame 4, aligned with or past the second unlocked position P2, in the closing movement direction F of the first leaf 3*a* relative to the frame 4, or between the second unlocked position P2 and the first unlocked position P1 and the second subassembly 22 is positioned opposite the second side 37 of the first subassembly 21, the movement of the first leaf 3*a* relative to the frame 4 comprises a movement in the opening direction O of the first leaf 3*a* relative to the frame 4 implemented at the first speed input V1 or at the second speed input V2, as a function of the configuration of the motorized drive device 5, preferably at the first speed input V1.

When a movement command order to the open position or the intermediate position is received by the electronic control unit 10 and the position of the second subassembly 22 relative to the first subassembly 21 is between the first unlocked position P1 and the second unlocked position P2 and the second subassembly 22 is positioned opposite the first side 36 of the first subassembly 21, the movement of the first leaf 3*a* relative to the frame 4 comprises a first movement in the closing direction F of the first leaf 3*a* relative to the frame 4 to the second unlocked position P2 implemented at the first speed input V1, then a second movement in the opening direction O of the first leaf 3*a* relative to the frame 4 implemented at the first V1 or second V2 speed input, as a function of the configuration of the motorized drive device 5, preferably at the first speed input V1.

Thus, during the first movement in the closing direction F of the first leaf 3*a* relative to the frame 4, the movement of the pin 24 of the second subassembly 22 is implemented, optionally, toward the cam 23 of the first subassembly 21, then along the first ramp 32 of the cam 23 and up to the second unlocked position P2. Furthermore, during the second movement in the opening direction O of the first leaf 3*a* relative to the frame 4, the movement of the pin 24 is implemented along the second ramp 33 of the cam 23 and, optionally, past the cam 23.

Additionally, the first movement in the closing direction F of the first leaf 3*a* relative to the frame 4 is implemented at the first speed input V1, such that the pin 24 does not engage in the slit 34 of the cam 23 and so as to accelerate reaching the unlocked position P2 by the pin 24.

Owing to the present invention, the motorized drive device of the sliding window makes it possible to move the leaf relative to the frame in a motorized manner and to reach the locked partially open position of the leaf relative to the frame, irrespective of the starting position of the movement of the leaf relative to the frame, while adapting the movement speed input of the leaf relative to the frame as a function of the operating conditions.

Furthermore, the motorized drive device of the sliding window makes it possible to reach the locked partially open position of the leaf relative to the frame, irrespective of the starting position of the second subassembly relative to the first subassembly of the locking device.

Many changes can be made to the example embodiment previously described without going beyond the scope of the invention defined by the claims.

In particular, the electric motor of the electromechanical actuator may be of the asynchronous or direct current type.

Furthermore, the motorized drive device 5 can be configured to move several leaves 3*a*, 3*b* by sliding using the flexible element 9, in a same movement direction or in opposite movement directions.

Furthermore, the considered embodiments and alternatives may be combined to generate new embodiments of the invention, without going beyond the scope of the invention defined by the claims.

The invention claimed is:

1. A method for controlling the operation of a motorized drive device of a sliding window for a building, the sliding window comprising:

a frame, at least one leaf, a device for locking the leaf relative to the frame in a locked partially open position, the locked partially open position being arranged between an open position and a closed position of the leaf relative to the frame, the motorized drive device being configured to move the leaf by sliding relative to the frame, the motorized drive device comprising:

an electromechanical actuator, the electromechanical actuator comprising an electronic control unit and an electric motor, the locking device comprising:

a first subassembly, the first subassembly being fastened on the frame, a second subassembly, the second subassembly being fastened on the leaf, the second subassembly being configured to cooperate with the first subassembly, during a movement of the leaf relative to the frame, so as to be able to lock the leaf relative to the frame in the locked partially open position, wherein the locked partially open position of the leaf relative to the frame corresponds to a locked position of the second subassembly relative to the first subassembly, wherein the method comprises at least the following step, carried out during a configuration phase of the motorized drive device:

determining reference positions of the second subassembly relative to the first subassembly, said reference positions comprising at least a docking position of the second subassembly relative to the first subassembly, the docking position being arranged before the locked partially open position of the leaf relative to the frame, in the opening movement direction of the leaf relative to the frame, wherein the method comprises at least the following steps, carried out during a command phase of the motorized drive device:

reception of a movement command order by the electronic control unit of the electromechanical actuator, moving the leaf relative to the frame at a first speed input or a second speed input, based on the received movement command order, at least one previous executed movement command order and the position of the second subassembly relative to the first subassembly, according to the determined reference positions, the second movement speed input being less than the first movement speed input, and wherein, when a command order to move to the locked partially open position is received by the electronic control unit, the movement of the leaf relative to the frame comprises a first movement in the closing direction of the leaf relative to the frame implemented at the second speed input, so as to move the second subassembly relative to the first subassembly to the docking position, then a second movement in the opening direction of the leaf relative to the frame implemented at the second speed input, so as to move the second subassembly relative to the first subassembly from the docking position to the locked position.

2. The method for controlling the operation of a motorized drive device of a sliding window for a building according to claim 1, wherein the reference positions of the second subassembly relative to the first subassembly also comprise at least:

a first unlocked position of the second subassembly relative to the first subassembly, in which the second subassembly is positioned before the first subassembly, in the closing movement direction of the leaf relative to the frame.

3. The method for controlling the operation of a motorized drive device of a sliding window for a building according to claim 2, wherein, when the position of the second subassembly relative to the first subassembly is past the first unlocked position, in the opening movement direction of the leaf relative to the frame, the movement of the leaf relative to the frame comprises a preliminary movement in the closing direction of the leaf relative to the frame, before the first movement, implemented at the first speed input, so as to move the second subassembly relative to the first subassembly to the first unlocked position.

4. The method for controlling the operation of a motorized drive device of a sliding window for a building according to claim 2, wherein the reference positions of the second subassembly relative to the first subassembly also comprise at least:

a second unlocked position of the second subassembly relative to the first subassembly, in which the second subassembly is positioned before the first subassembly, in the opening movement direction of the leaf relative to the frame.

5. The method for controlling the operation of a motorized drive device of a sliding window for a building according to claim 4, wherein, when the position of the second subassembly relative to the first subassembly is aligned with or past the second unlocked position, in the closing movement direction of the leaf relative to the frame, the movement of the leaf relative to the frame comprises a preliminary movement in the opening direction of the leaf relative to the frame, before the first movement, implemented at the first speed input, so as to move the second subassembly relative to the first subassembly to the first unlocked position.

6. The method for controlling the operation of a motorized drive device of a sliding window for a building according to claim 4, wherein, when the position of the second subassembly relative to the first subassembly is between the second unlocked position and the first unlocked position and the second subassembly is arranged opposite a side of the first subassembly comprising only a sliding ramp of the second subassembly along the first subassembly, the movement of the leaf relative to the frame comprises a preliminary movement in the opening direction of the leaf relative to the frame, before the first movement, implemented at the first speed input, so as to move the second subassembly relative to the first subassembly to the first unlocked position.

7. The method for controlling the operation of a motorized drive device of a sliding window for a building according to claim 4, wherein, when the position of the second subassembly relative to the first subassembly is undetermined, the movement of the leaf relative to the frame comprises a first preliminary movement in the closing direction of the leaf relative to the frame implemented at the first speed input, so as to move the second subassembly relative to the first subassembly to the second unlocked position, then a second preliminary movement in the opening direction of the leaf relative to the frame implemented at the first speed input, so as to move the second subassembly relative to the first subassembly to the first unlocked position, the first and second preliminary movements being implemented before the first movement.

8. The method for controlling the operation of a motorized drive device of a sliding window for a building according to claim 1, wherein, after reaching the locked position, the movement of the leaf relative to the frame comprises a withdrawal movement along the closing direction of the leaf relative to the frame implemented at the second speed input, so as to limit the stresses exerted by the second subassembly on the first subassembly.

9. The method for controlling the operation of a motorized drive device of a sliding window for a building according to claim 1, wherein, after reaching the locked position, the method comprises a step for keeping the leaf in position relative to the frame using a brake of the electromechanical actuator.

* * * * *